US006453474B2

(12) United States Patent
Kleinert

(10) Patent No.: US 6,453,474 B2
(45) Date of Patent: Sep. 24, 2002

(54) HOCKEY GOALTENDER CATCH GLOVE

(75) Inventor: James M. Kleinert, Glenview, KY (US)

(73) Assignee: Hillerich & Bradsby Co., Louisville, KY (US)

( * ) Notice: Subject to any disclaimer, the term of this patent is extended or adjusted under 35 U.S.C. 154(b) by 0 days.

(21) Appl. No.: 09/957,567

(22) Filed: Sep. 20, 2001

Related U.S. Application Data

(63) Continuation-in-part of application No. 09/867,084, filed on May 29, 2001, which is a continuation-in-part of application No. 09/491,742, filed on Jan. 27, 2000, now Pat. No. 6,253,382.

(51) Int. Cl.[7] ..... A41D 13/08; A63B 71/14

(52) U.S. Cl. ..... 2/161.1; 2/16

(58) Field of Search ..... 2/16, 19, 161.1, 2/159, 164, 163

(56) References Cited

U.S. PATENT DOCUMENTS

| | | | | | |
|---|---|---|---|---|---|
| 325,968 | A | * | 9/1885 | Rawlings | 2/164 |
| 3,605,117 | A | * | 9/1971 | Latina | 2/16 |
| 4,747,163 | A | * | 5/1988 | Dzierson | 2/161.1 |
| 4,967,418 | A | * | 11/1990 | Marcotte | 2/16 |
| 5,136,725 | A | | 8/1992 | Montero | |
| 5,511,244 | A | | 4/1996 | Shikatani | |
| 5,551,083 | A | | 9/1996 | Goldsmith | |
| 5,557,803 | A | * | 9/1996 | Granich et al. | 2/16 |
| D389,283 | S | | 1/1998 | Goldsmith | |
| 5,717,994 | A | | 2/1998 | Goldsmith | |
| 5,720,047 | A | | 2/1998 | Spitzer | |
| 5,781,929 | A | | 7/1998 | Shikatani | |
| 5,809,571 | A | | 9/1998 | Spitzer | |
| 6,256,792 | B1 | * | 7/2001 | MacDonald | 2/160 |

FOREIGN PATENT DOCUMENTS

WO 98/27837 * 7/1998

* cited by examiner

*Primary Examiner*—Rodney M. Lindsey
(74) *Attorney, Agent, or Firm*—Charles G. Lamb; Middleton & Reutlinger

(57) ABSTRACT

A hockey catch glove includes shock absorbing pads in the areas above and below the center axis of rotation of the metacarpalphalangeal joint of the index finger. Additional shock absorbing pads may extend to areas above and below the center axis of rotation of the proximal interphalangeal joints of all of the fingers as well as the metacarpalphalangeal joints of the fingers and the bony prominences of the thumb. Even additionally, stiffeners may be sandwiched between the shock absorbing pads and a bottom panel on the palmar side of the glove.

14 Claims, 14 Drawing Sheets

HOCKEY GOALTENDER CATCH GLOVE

CROSS REFERENCE TO RELATED APPLICATIONS

This is a continuation-in-part of U.S. patent application Ser. No. 09/867,084 filed May 29, 2001 which is a continuation of Ser. No. 09/491,742 filed Jan. 27, 2000 now U.S. Pat. No. 6,253,382.

BACKGROUND OF THE INVENTION

1. Field of the Invention

This invention relates to gloves for the human hand which are worn when playing sports such as baseball, softball, and the like. In one aspect, this invention relates to a batting glove specifically designed to improve grip, comfort, protection, and performance of a wearer. However, this invention has broader applications and may be advantageously employed in other applications requiring protection of the hands. More particularly, this invention relates to a hockey catch glove which includes additional padding in selected areas to provide additional protection of the hand during use by the wearer.

2. Description of Related Art

Glove construction for protection of the human hand is well known. In addition, there are a number of patents which teach gloves claimed to be particularly useful as batting gloves. For example, U.S. Pat. No. 3,175,226 teaches a dress glove construction which completely covers the fingers and which includes resiliently expandable materials in selected areas to accommodate hands of different sizes. In contrast, U.S. Pat. No. 4,561,122 teaches a protective glove which has a wrap around construction for a protective glove which leaves the thumb and fingers ends exposed. U.S. Pat. No. 5,345,609 teaches a protective glove which includes shock absorbing cells disposed at selected portions along the top of the glove. U.S. Pat. No. 5,790,980 teaches a hand glove with a polyurethane foam pad in the palm portion of the glove. Other references attempt to provide a sport glove for supporting and stabilizing the wrist and hand. Current gloves protect the bony prominence areas of the hand. Although hand protection from direct shocks and abrasions is found in gloves of the current art, what is needed is a batting glove which provides improved grip, comfort and performance by unloading bony prominences, unloading pulleys and tendons, and improving finger and knuckle motion of the hand of a wearer by providing preselected thicknesses of preselected materials specifically chosen to protect the wearer from injury from distributed shocks in hitting a ball with a bat, and the attendant risk of long-term injury to the aforementioned bones, ligaments, pulleys, tendons, etc., by repetitive swinging of bats and hitting of balls.

Also, catch gloves for use by goaltenders (goalies) in hockey are well known. These gloves are generally constructed wherein the gloves are of generally oblong construction with a cut-out between a portion to receive the thumb of a wearer and the fingers of a wearer with webbing disposed between the thumb section and the finger section. The goaltender's catch glove is used primarily to catch a flying puck, to recover the puck on the ice when not caught, or to assist the goaltender in the use of his stick in passing the puck to another player. However, very little consideration has been given to specific anatomical portions of the human hand to protect those anatomical portions which are most susceptible to injury when the wearer attempts to catch or otherwise retrieve a hard hit puck.

SUMMARY OF THE INVENTION

In the development of gloves, several key elements are utilized in the design. First, on the dorsal side of the glove, the motion zones are determined by the center axis of rotation of the individual thumb, finger, hand, and wrist joints. These motion zones have been applied to specific joint locations for the particular uses of a designed glove. This helps the flexibility of the glove in relationship to its use. As such, the motion zones are selected in various combinations or even individually depending on the specific task or function of the glove.

Secondly, on the palm side of the glove there are additional motion zones. Again, these motion zones, which also function to decrease glove impedance and improve the breath-ability of the glove, are located specifically in relationship to the center axis of rotation of the finger joints.

Thirdly, again on the palm side of the glove, there are specific areas of padding. The location of the padding is determined by the bone and joint anatomy of the hand, fingers, and thumb. For the hand, the palm pad is placed above the center axis of rotation of the wrist (i.e., just above or distal to the hook of the hamate) and just below the center axis of rotation of the metacarpal heads. These bony landmarks are actually quite prominent in relationship to the surface of the hand. By placing the pads between the bony prominences, these areas of the hand are unloaded. The type of pad chosen for the palm is specific to its function. Other applications require some adjustments to the pad, but the basic premise still remains to unload the bony prominences of the hand in relationship to the required object to be held.

The pads for the fingers are placed again between the bony prominences of each specific finger bone (phalanx). The individual pads of the digits are placed over the relatively flat portion of the phalanx and as such, between the joints that are present on each side of the respective phalanx. The pad does not cover the area near the center axis of rotation. Again, this unloads these bony areas and leads to more even distribution of force across the digit. In other words, decreased areas of concentrated pressure, i.e, over the bony prominences and individuals will experience less discomfort. Of course, improved comfort leads to better grip and performance of the specific task in question. The pads on the fingers are placed over the proximal and middle phalanx of each digit. Because of the relative bony and flexor tendon pulley anatomy, these regions correlate with the A2 and A4 pulleys specifically. Furthermore, this placement allows for unrestricted motion of the various finger and hand joints by precisely keeping the pads away from the center axis of rotation (for each specific joint). Depending on the use of the glove, various combinations, or even independent use of these pads could be utilized in glove construction. Additionally, the pads may have different sizes and shapes depending on the application. However, the pads would still be centered primarily between the bony prominences and away from the center axis of rotation for each joint.

The pad for the thumb is placed between the bony prominences of the first phalanx, primarily on the lateral (side) region. Again, the pad is located above the center axis of rotation of the metacarpalphalangeal joint of the thumb and below the center axis of rotation of the interphalangeal joint of the thumb. other applications to this pad placement are quite numerous. Even this pad could be an application in combination with all, some, one, or none of the finger and palm pads depending on the task.

Optionally, pads may also be placed over the distal phalanx of each digit, just beyond the bony prominences. This pad would be above (distal) the center axis of the rotation of the distal interphalangeal joint of the respective finger. As such, three pads could be placed over each finger depending on the use required for the glove.

The motion zone for the wrist area is also determined by the center axis of rotation of the wrist joint. This allows for essentially full motion of the wrist, while at the same time, avoiding dislodgement of the glove from the player's hand. Not all gloves require or benefit from a wrist motion zone. However, a combination of the finger, thumb, hands and wrist motion zones determined by the joints center axis of rotation may be utilized for various glove applications.

An object of the present invention is to provide a batting glove which takes stress off of selected parts of the human hand.

Another object of the present invention is to provide a batting glove having preselected materials of construction in different areas of contact with the human hand.

A further object of the present invention is to provide a batting glove having preselected thicknesses of preselected materials of construction in different areas of contact with the human hand.

Yet another object of the present invention is to provide a batting glove which uses different materials to allow wrist motion, unload bony prominences, improve finger and knuckle motion, and protect the back of the hand.

Also, an object of the present invention is to provide a hockey goalie's catch glove which takes stress off of selected parts of the human hand when the glove is in use.

Another object of the present invention is to provide a hockey goalie's catch glove with additional padding added to selected areas of the glove for protecting selected anatomical portions of the human hand.

In one aspect, the present invention provides a batting glove including preselected material in preselected thicknesses to fill in the soft spots surrounding the bony prominences of the hand, to unload the pulleys and tendons, and to take stress off of selected parts of the hand. Specifically, 2-Way SPANDEX® materials are used in the wrist motion zone of the glove; thin elastic material such as LYCRA® is used in the area of the finger joints and knuckles; synthetic material such as JANEC SUPER® is used in the area of the dorsal side of the fingers; a cabretta skin protective covering is used for selected parts of the hand, rubber foam protective padding is placed at selected contact areas, and soft padding such as terry cotton is placed inside the it glove in selected areas.

More particularly, in another aspect, the present invention provides a hockey catch glove which includes a bottom glove panel sized to cover a palm, thumb and fingers of a human hand and a top glove panel sized to cover the back or dorsal side of a human hand. The top and bottom glove panels are secured along each panel's periphery to define a glove body with an opening therein to receive a human hand. Disposed between the top and bottom glove panels within the glove body are thumb and finger sections for receiving a thumb and fingers of the human hand. A pocket, usually including a web-type material, is disposed between the thumb section and the fingers section. At least a first shock absorbing pad and a second shock absorbing pad are disposed above and below the center axis of rotation of a metacarpalphalangeal joint of an index finger.

Further objects and advantages of this invention will appear from the following description and appended claims, reference being had to the accompanying drawings forming a part of the specification wherein like reference characters designate corresponding parts into several views.

BRIEF DESCRIPTION OF THE DRAWINGS

A better understanding of the invention will be had upon reference to the following description in conjunction with the accompanying drawings in which like numerals refer to like parts throughout the several views and wherein.

DESCRIPTION OF THE PREFERRED EMBODIMENTS

A. Batting Glove

Figure 1:
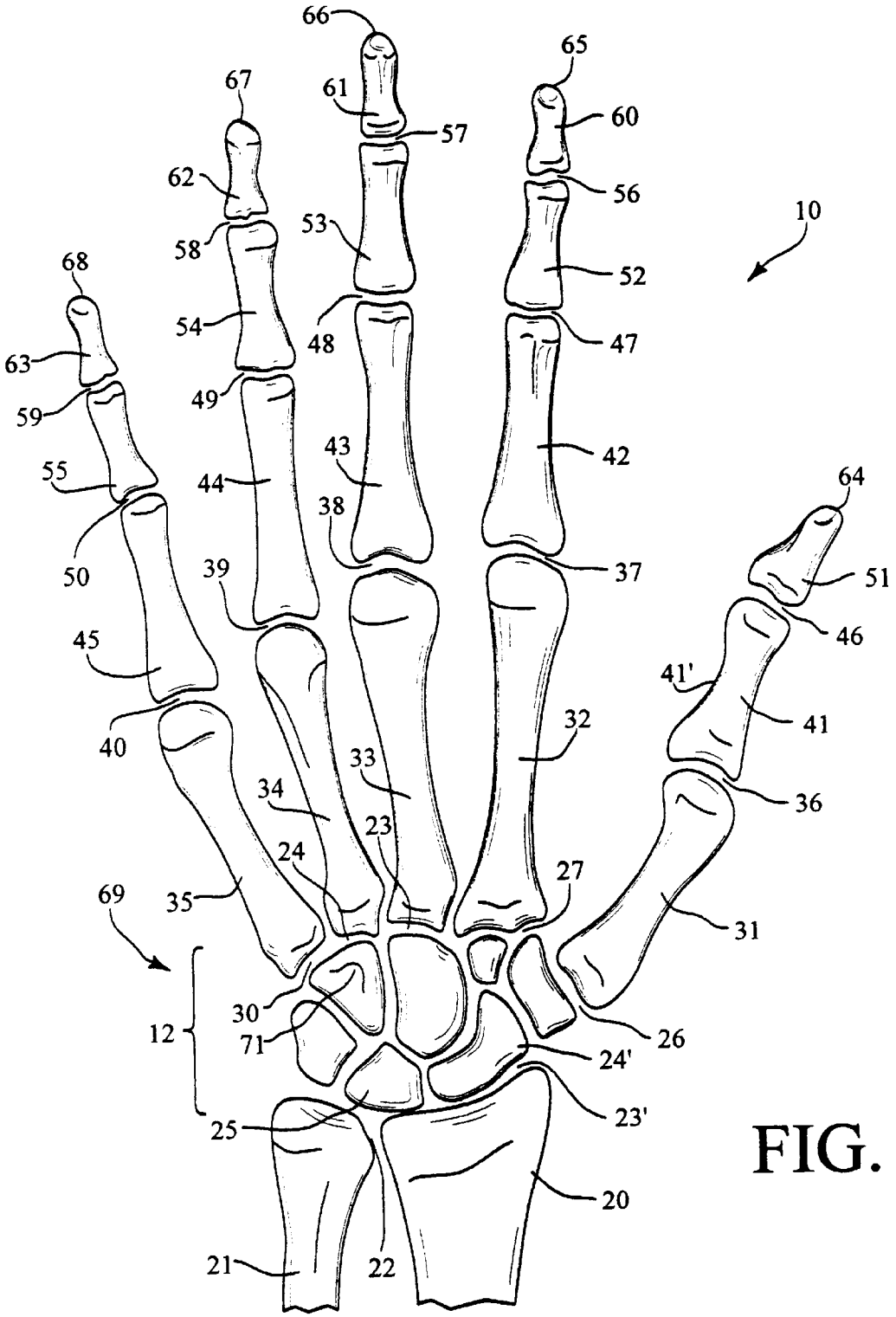
FIG. 1 is a bottom schematic anatomical view of the bones. of a right-side human hand showing the palm-side details.

FIG. 1 is a schematic anatomical view of the bones of a right human hand 10 looking at a palm 18 side. Shown are the radius 20, ulna 21, radiocarpal joint (RC) 23', distal radio ulnar joint (DRUJ) 22, wrist 12, thumb 64, index finger 65, long finger 66, ring finger 67, and small finger 68. The carpus 69 comprises eight carpal bones, seven of which are shown in FIG. 1 and includes the hamate bone 71 with its hook-like protrusion, the scaphoid 24' and the lunate 25.

The thumb 64 is comprised of the distal phalanx 51, the interphalangeal joint (IP) 46, proximal phalanx 41, diaphysis of proximal phalanx 41', metacarpalphalangeal joint (MCP) 36, metacarpal 31, and carpometacarpal joint (CMC) 26.

The index finger 65 is comprised of the distal phalanx 60, distal interphalangeal joint (DIP) 56, middle phalanx 52, proximal interphalangeal joint (PIP) 47, proximal phalanx 42, metacarpalphalangeal joint (MCP) 37, metacarpal 32, and carpometacarpal joint (CMC) 27.

The long finger 66 is comprised of the distal phalanx 61, distal interphalangeal joint (DIP) 57, middle phalanx 53, proximal interphalangeal joint (PIP) 48, proximal phalanx 43, metacarpalphalangeal joint (MCP) 38, metacarpal 33, and carpometacarpal joint (CMC) 23.

The ring finger 67 is comprised of the distal phalanx 62, distal interphalangeal joint (DIP) 58, middle phalanx 54, proximal interphalangeal joint (PIP) 49, proximal phalanx 44, metacarpalphalangeal joint (MCP) 39, metacarpal 34, and carpometacarpal joint (CMC) 24.

The small finger 68 is comprised of the distal phalanx 63, distal interphalangeal joint (DIP) 59, middle phalanx 55, proximal interphalangeal joint (PIP) 50, proximal phalanx, 45, metacarpalphalangeal joint (MCP) 40, metacarpal 35, and carpometacarpal joint (CMC) 30.

Figure 1A:
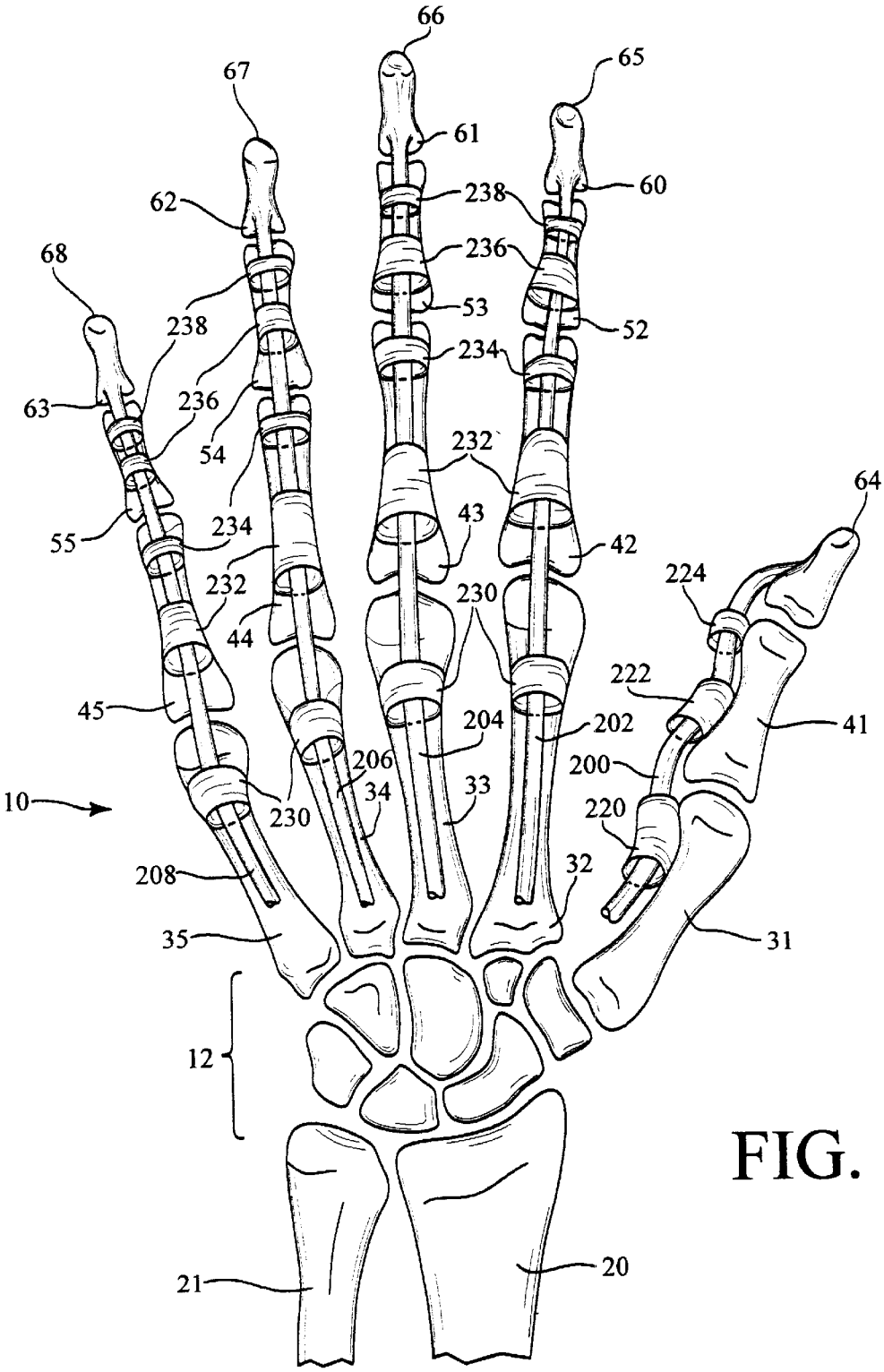
FIG. 1A is a bottom schematic anatomical palm-side view of the bones, and selected details of the pulleys and tendons of a right-side human hand.

FIG. 1A shows the skeletal anatomy, pulley system, and flexor tendons of the thumb 64 and fingers 65–68 of the right hand 10. The thumb 64 includes the flexor tendon (flexor pollicis longus) 200 and the three pulleys 220–224 of the thumb 64; an A1 pulley 220, A2 pulley 222, and A3 pulley 224. The A2 pulley 222 is the most important for function and is attached to the proximal phalanx 41 of the thumb 64. The respective pulleys 230–238 are also shown for each of the: index finger 65, long finger 66, ring finger 67, and small finger 68. Each finger 65–68 has five pulleys 230–238; an A1 pulley 230, A2 pulley 232, A3pulley 234, A4 pulley 236, and A5 pulley 238. The A2 pulley 232 and A4 pulley 236 are considered to be the most important for function. The A2 pulley 232 is attached to the proximal phalanx 42–45. The A4 pulley 236 is attached to the middle phalanx 52–55. The A1 pulley 230 is near the MCP joint 37–40, the A3 pulley 234 is near the PIP joint 46–50 and the A5 pulley 238 is near the DIP joint 56–59.

Figure 4:
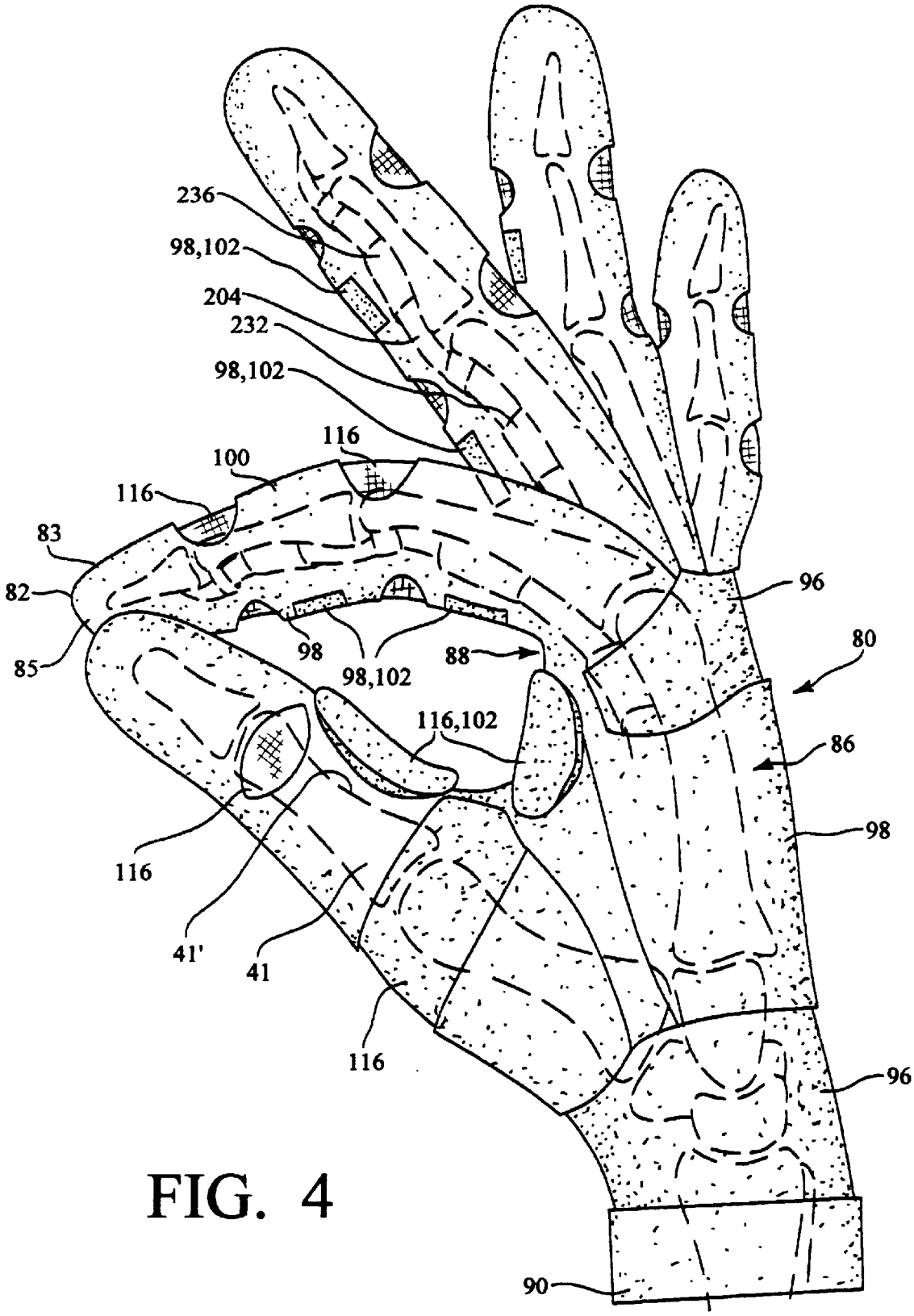
FIG. 4 is a radial side view of a batting glove of a preferred embodiment of the present invention showing relevant details and seen overlaying the skeletal structure of a right-side human hand.

The flexor tendons 202–208 are shown as one unit for each finger 65–68, but actually there are two flexor tendons to each unit. They are the flexor digitorum superficialis and the flexor digitorum profundus (shown as one, 202–208). These tendons 202–208 travel underneath the pulleys 230–238 and the flexor digitorum profundus tendon attaches to the distal phalanx 60–63 of each finger 65–68. The tendons 202–208 move back and forth below the pulleys 230–238, via muscles (not shown) attached to the proximal end of the tendons. This movement of the tendon 202–208 produces finger 65–68 flexion. The pulleys 230–238 prevent the flexor tendons 202–208 from bowstringing or moving away from the bone with finger 65–68 flexion. If the pulleys 230–238 are damaged and no longer function, the tendons 202–208 will bowstring with a resultant significant loss of finger motion as well as grip strength. As such, pulleys 230–238, especially the A2 pulley 232 and the A4 pulley 236, are very important and must be preserved and protected as much as possible. As shown in FIG. 4, protective padding 102 for each finger 65–68 is placed in an anatomically designed fashion over the A2 and A4 pulley regions. When the A2 and A4 pulleys 232 and 236 are preserved, adequate finger 65–68 motion and grip strength is maintained.

In FIGS. 2–5, a preferred batting glove 80 is provided for either a right, left, or both human hand(s) 10, as desired. A glove 80 for a left hand 10 utilizes symmetrical placement of the elements, materials, and thicknesses herein described.

Figure 2:
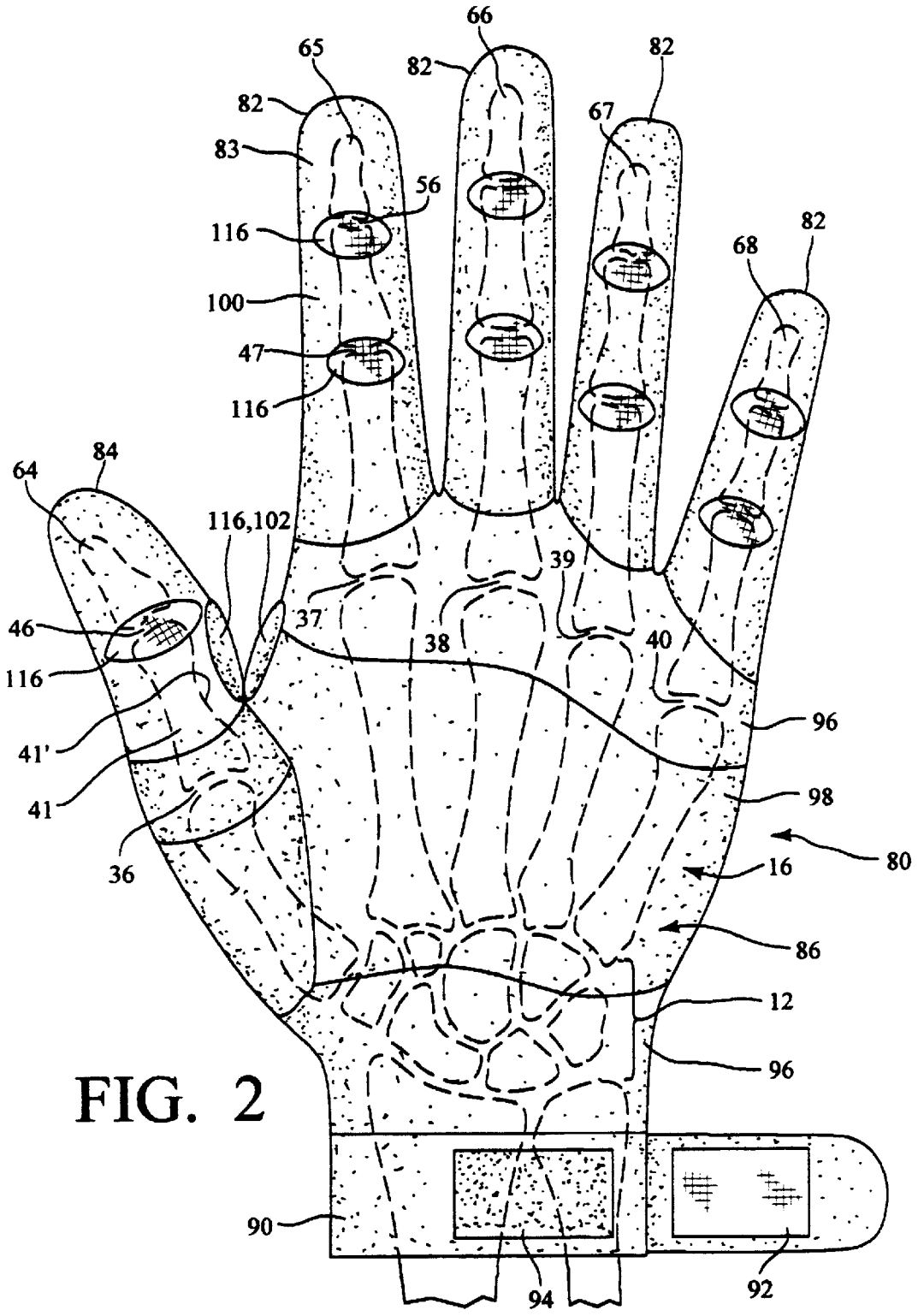
FIG. 2 is a top view of a batting glove of a preferred embodiment of the present invention showing the dorsal-side details and seen overlaying the skeletal structure of a right-dorsal-side human hand.

FIG. 2 shows details of a dorsal side of a batting glove 80 to cover a human hand 10 and seen overlaying the skeletal structure and skin outline of a right-dorsal-side human hand 10.

The batting glove 80 has a plurality of finger elements 82, a thumb element 84, a top portion 86, and a lower portion 88 (see FIGS. 3-5), wherein the finger elements 82 cover fingers 65–68. The thumb element 84 covers a thumb 64, and the top portion 86 covers a back side 16 of the hand 10. The lower portion 88 covers the palm side 18 of the hand 10.

An elastic band 90 is attached to the top portion 86 and to the lower portion 88. The elastic band 90 includes a securing means in the form of a hook 92 and loop 94 fastener for retention above a human wrist 12.

The top portion 86 includes elastic material 96, preferably 2-WAY SPANDEX® in the vicinity of the wrist 12 out to the vicinity of the metacarpalphalangeal joints (MCP) 37–40 of the fingers 65–68 of the hand 10. Additionally, a protective covering 98 is centrally located to cover the back side 16 of the hand 10.

The finger elements 82 each include an upper portion 83 which includes synthetic material 100 with openings formed therein to receive thin elastic material 116 attached to cover the proximal interphalangeal joints (PIP) 47–50, and the distal interphalangeal joint (DIP) 56–59 of each finger 65–68.

Figure 3:
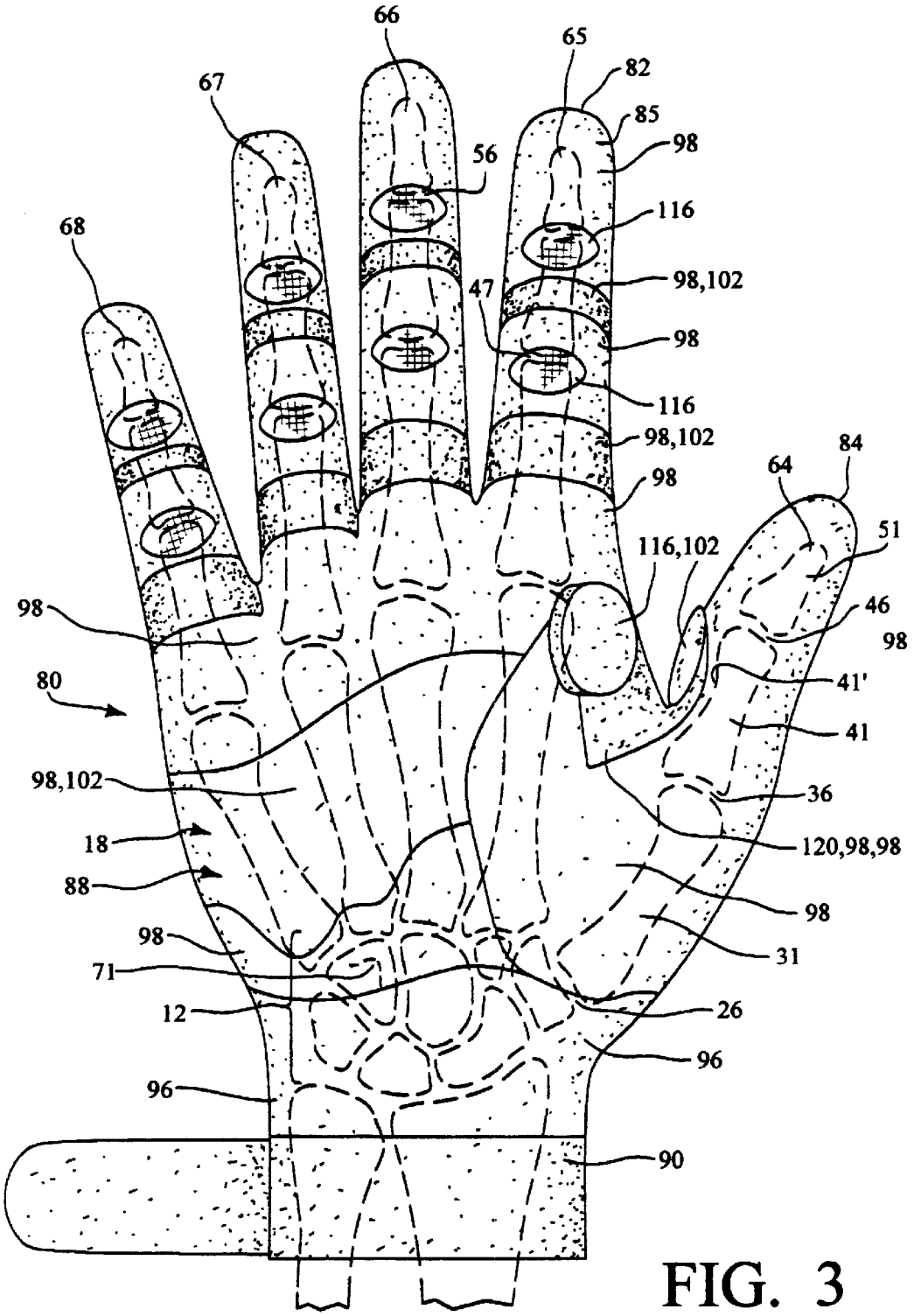
FIG. 3 is a bottom view of a batting glove of a preferred embodiment of the present invention showing the palm-side details and seen overlaying the skeletal structure of a right-palm-side human hand.

As shown in FIG. 3, a lower portion 85 of the finger elements 82 includes protective covering 98. In addition, protective padding 102 is affixed beneath the protective covering 98 and adjacent to the fingers 65–68, in preselected areas. As shown in FIGS. 3 and 4, protective padding 102 and protective covering 98 cover the middle phalanx 52–55—specifically the A4 pulley 236 region, and the proximal phalanx 42–45—specifically the A2 pulley 232 region, of each finger 65–68. Openings are formed in the lower portion 85 to receive thin elastic material 116 attached to cover the palm-side 18 of the proximal interphalangeal joints (PIP) 47–50, and the distal interphalangeal joints (DIP) 56–59 of each finger 65–68.

The thumb element 84 includes protective covering 98 which surrounds the distal phalanx 51, metacarpalphalangeal joint (MCP) 36, proximal phalanx 41, metacarpal 31, and carpometacarpal joint (CMC) 26 of the thumb 64. As shown in FIG. 2, an opening is formed in the protective covering 98 to receive thin elastic material 116 attached to cover the interphalangeal joint (IP) 46 of the thumb 64. Another opening is formed in the protective covering 98 over the metacarpalphalangeal joint (MCP) 36 to receive thin elastic material 116. As shown in FIGS. 2–5, a piece of protective padding 102, which is itself covered by thin elastic material 116, is affixed to an area on the thumb element 84 and centered on an ulnar border (inside) of the thumb 64 over the diaphysis of proximal phalanx 41' of the thumb 64. The diaphysis of proximal phalanx 41' is found between the metacarpalphalangeal joint (MCP) 36 and interphalangeal joint (IP) 46 of the thumb 64.

Referring again to FIG. 3, the bottom portion 88 includes elastic material 96 in the vicinity of the wrist 12. Out from the wrist 12 area, the bottom portion 88 includes protective covering 98 continuing out to the vicinity of the metacarpalphalangeal joints (MCP) 36–40 and located to cover the palm 18 of the hand 10. A piece of protective padding 102 is affixed to a central palm 18 area underneath the protective covering 98 and placed at a preselected distance below a center axis of rotation of the metacarpalphalangeal joints (MCP) 37–40 and extending to a preselected distance above the hook of the hamate 71.

Figure 3A:
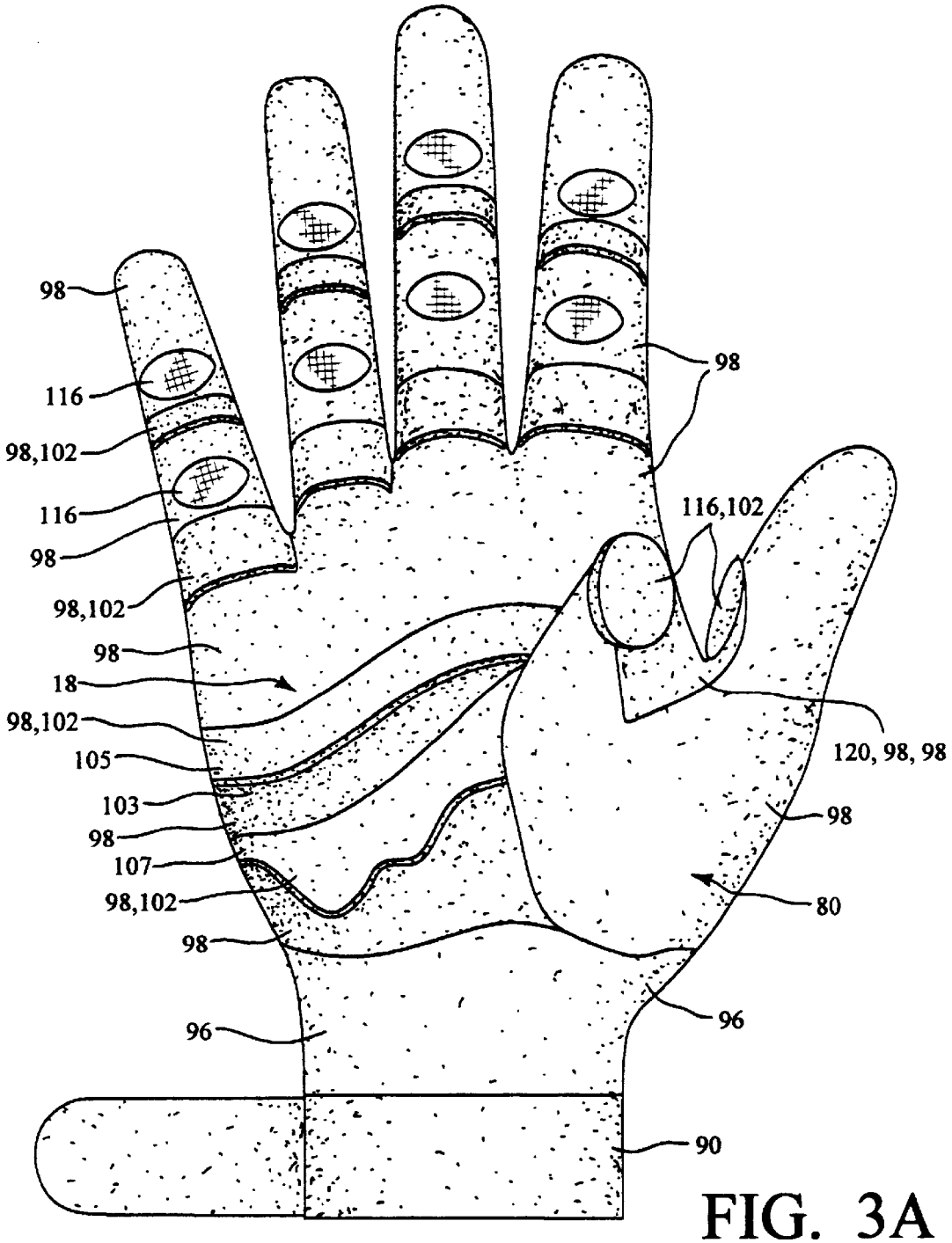
FIG. 3A is a bottom view of another batting glove of a preferred embodiment of the present invention showing relevant palm-side details.

As shown in FIG. 3A, another preferred embodiment of the batting glove 80 is similar to the glove 80 of FIG. 3, but is distinguished wherein a central portion 103 of the central palm 18 area is provided having no protective padding 102 and abutting two separate sections, a first section 105, and a second section 107. Both the first section 105 and the second section 107 include affixing protective padding 102 underneath the protective covering 98. The central portion 103 includes protective covering 98, but no protective padding 102. When viewed as in FIG. 3A, an overall outline of the central palm 18 area is similar to that of the glove of FIG. 3, except that the central portion 103 appears to be relieved or depressed in relation to the first section 105 and the second section 107.

Referring back to FIG. 3, a first web 120 is formed in the area where the thumb element 84 is in proximity to the index 25 finger 65. An additional piece of protective covering 98 (thereby creating a double thickness of protective covering 98) is affixed over the first web 120. A piece of protective padding 102 covered by thin elastic material 116 is affixed over the additional piece of protective padding 98 over the first web 120 to cover an area which is contacted by protective padding 102 of the thumb element 84. When the glove 80 is worn by a wearer, the bottom portion 88 contacts the remainder of the palm 18.

Figure 5:
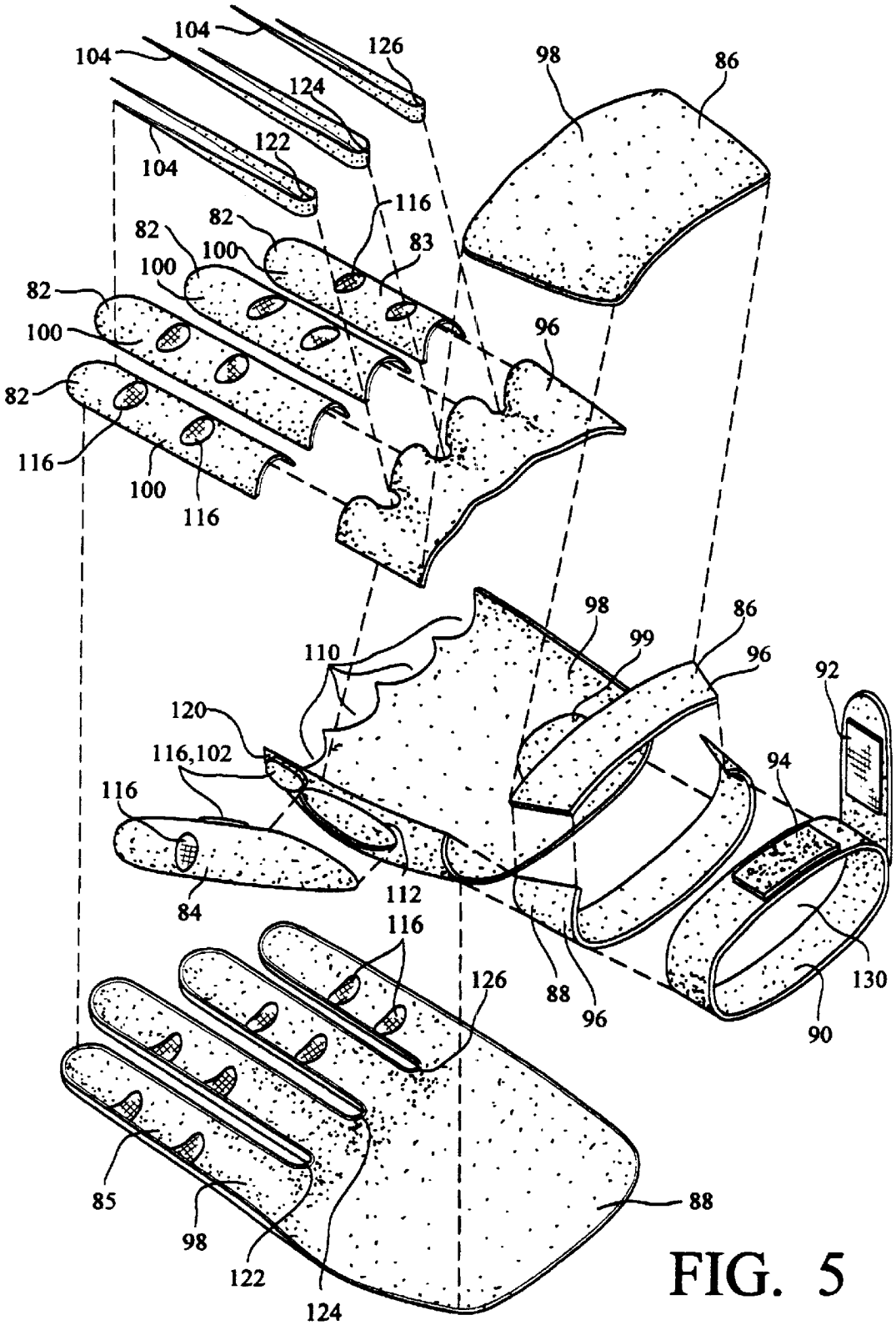
FIG. 5 is an exploded view of some of the major components of a batting glove of a preferred embodiment of the present invention.

Referring to FIG. 5, the bottom portion 88 is attached to the top portion 86 to enable an entire covering of the palm 18 and the back side 16 of the hand 10 along an outer periphery having at selected locations a plurality of finger openings 110, a thumb opening 112, and a main opening 130. Second, third and fourth webs, 122, 124, and 126, respectively, are formed between adjacent fingers 65–68. The finger elements 82 are fixedly attached to each of the finger openings 110. The batting glove 80 further provides the finger elements 82 with elastic webbing material 104 affixed laterally therebetween beginning at a tip of the index finger 65 down to the second web 122, running up to the long finger 66 and continuing likewise terminating at the tip of the small finger 68 just past the fourth web 126. Soft padding 99 such as terry cotton is placed as desired inside of the batting glove to cover the thicker protective padding 102, preferably in the areas of the palm 18 and pulleys of the fingers 65–68, and to provide for the comfort of the wearer.

Materials used in manufacture are preselected to achieve various goals as follows:

Synthetic material 100, such as, for example, JANEC SUPER® is used dorsally over the fingers 65–68 of the hand 10;

2-Way Elastic material 96, such as, for example, 2-WAY SPANDEX® is used in motion zones of the hand 10 to allow glove 80 movement;

Thin elastic material 116, such as, for example, LYCRA® is used to cover areas on the glove 80 based on centers of axes of rotation of all joints of the fingers 65–68 and thumb 64 of the hand 10;

Protective covering 98, such as, for example, cabretta skin (Indonesian sheep skin) is used to provide for protection from abrasion and direct shock applied to the hand in gripping a bat (not shown) and hitting a ball (not shown) with the bat; and, Protection padding 102, such as, for example, rubber foam of 1/16" in thickness, is used to enhance a gripping surface of he fingers 65–68, specifically the regions of the A2 pulley 232 and A4 pulley 236, and in the palm 18 and first web 120 in order to reduce the most severe of shocks transmitted to the hand 10.

The disclosure given is applicable not only to batting gloves, but also to gloves intended for use in various other activities such as, for example, golf, and working in the outdoors to include gardening. Protection for the hands 10 during use in such activities is achieved by measures such as, for example, varying quantity, placement, thickness, dimensions, and elastic qualities of pads, coverings, elastic materials and openings, as appropriate.

B. Hockey Goalie's Catch Glove

Figure 7:
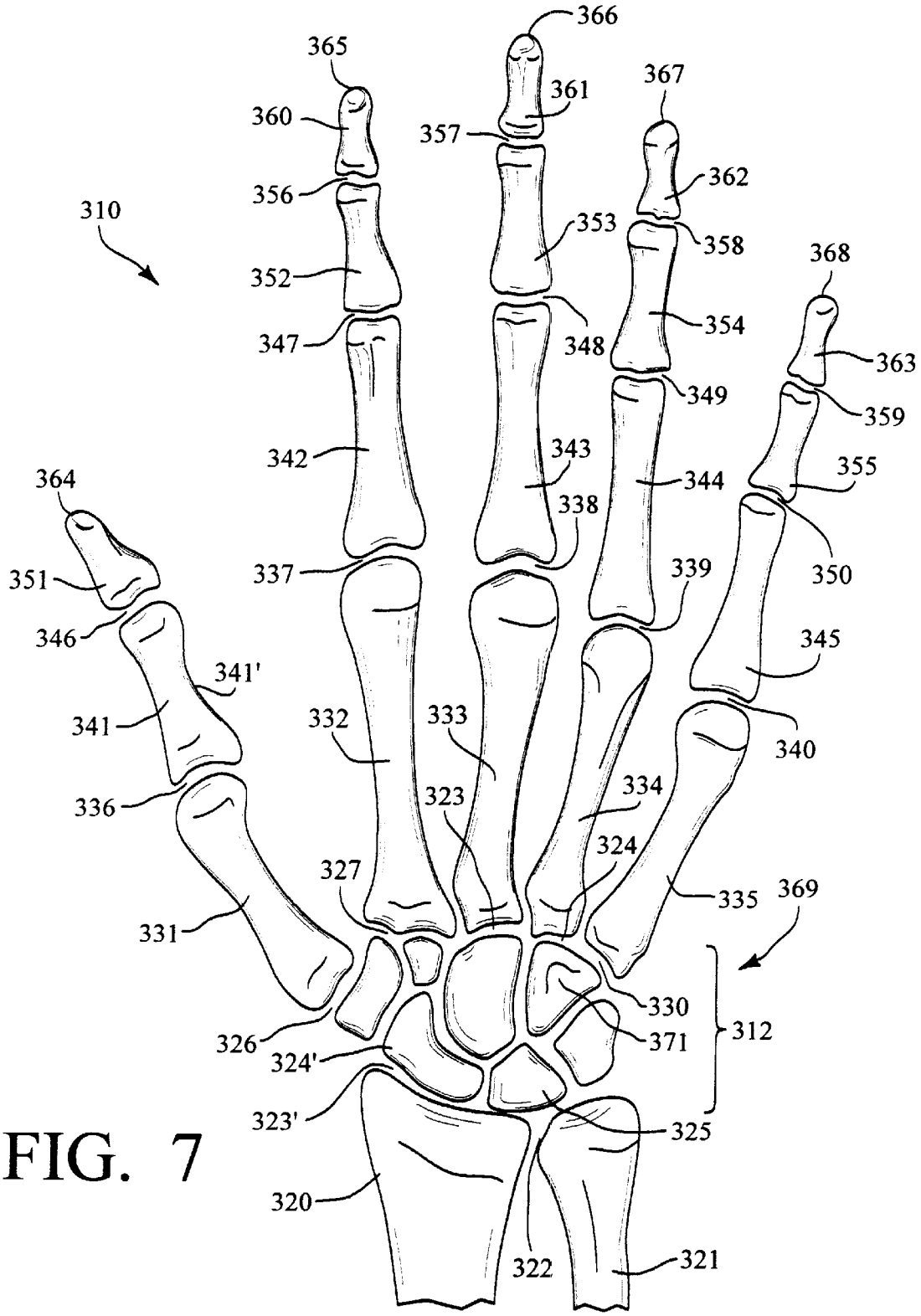
FIG. 7 is a bottom schematic anatomical view of a left human hand showing the palm-side detail.

FIG. 7 is a schematic anatomical view of the bones of a left human hand 310 looking at a palm side. Shown are the radius 330, ulna 321, radiocarpal joint (RC) 323', distal radio ulnar joint (DRUJ) 322, wrist 312, thumb 364, index finger 365, long finger 366, ring finger 367, and small finger 368. Also shown is a carpus 369 which comprises eight carpal bones, seven of which are shown in FIG. 7. This includes the hamate bone 371 with its hook-like protrusion, the scaphoid 324' and the lunate 325.

The thumb 364 is comprised of the distal phalanx 351, the interphalangeal joint (IP) 346, proximal phalanx 341, diaphysis proximal phalanx 341', metacarpalphalangeal joint (MCP) 336, metacarpal 331, and carpometacarpal joint (CMC) 326.

The index finger 365 is comprised of the distal phalanx 360, distal interphalangeal joint (DIP) 356, middle phalanx 352, proximal interphalangeal joint (PIP) 347, proximal phalanx 342, metacarpalphalangeal joint (MCP) 337, metacarpal 332, and carpometacarpal joint (CMC) 327.

The long finger 366 is comprised of the distal phalanx 361, distal interphalangeal joint (DIP) 357, middle phalanx 353, proximal interphalangeal joint (PIP) 348, proximal phalanx 343, metacarpalphalangeal joint (MCP) 338, metacarpal 333, and carpometacarpal joint (CMC) 323.

The ring finger 367 is comprised of the distal phalanx 362, distal interphalangeal joint (DIP) 358, middle phalanx 354, proximal interphalangeal joint (PIP) 349, proximal phalanx 344, metacarpalphalangeal joint (MCP) 339, metacarpal 334, and carpometacarpal joint (CMC) 324.

The small finger 368 is comprised of the distal phalanx 363, distal interphalangeal joint (DIP) 359, middle phalanx 355, proximal interphalangeal joint (PIP) 350, proximal phalanx 345, metacarpalphalangeal joint (MCP) 340, metacarpal 335, and carpometacarpal joint (CMC) 330.

Figure 7A:
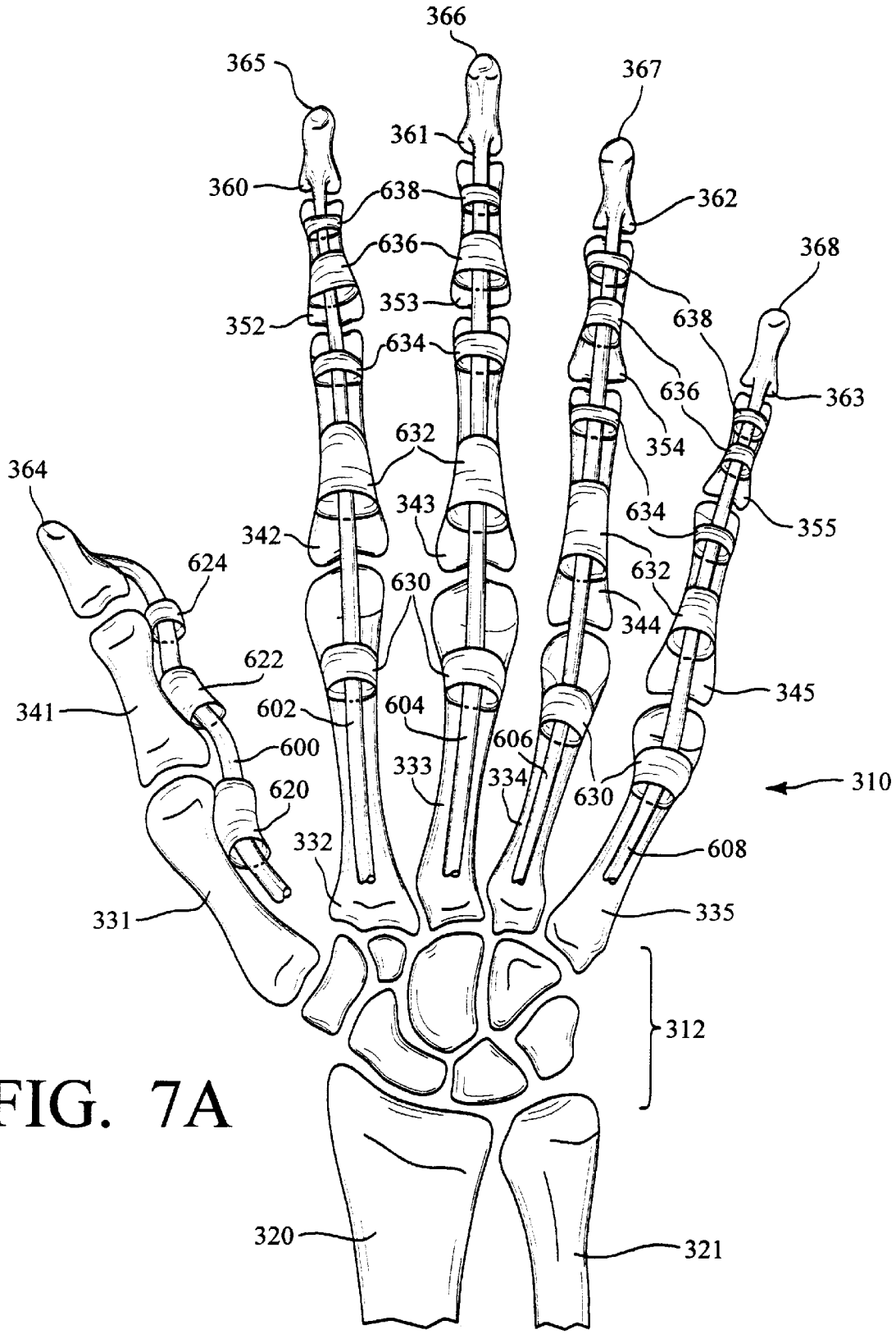
FIG. 7A is a bottom schematic anatomical side view of the bones and selected details of the pulleys and tendons of a left human hand.

FIG. 7A shows the skeletal anatomy, pulley system, and flexor tendons of the thumb 364 and fingers 365–368 of the left hand 310. The thumb 364 includes the flexor tendon (flexor pollicis longus) 600 and the three pulleys 620–624 of the thumb 364; an A1pulley 620, A2 pulley 622, and A3 pulley 624. The A2 pulley 622 is the most important for function and is attached to the proximal phalanx 341 of the thumb 364. The respective pulleys 630–638 are also shown for each of the: index finger 365, long finger 366, ring finger 367, and small finger 368. Each finger 365–368 has five pulleys 630–638; an A1 pulley 630, A2 pulley 632, A3 pulley 634, A4 pulley 636, and A5 pulley 638. The A2 pulley 632 and A4 pulley 636 are considered to be the most important for function. The A2 pulley 632 is attached to the proximal phalanx 342–345. The A4 pulley 636 is attached to the middle phalanx 352–355. The A1 pulley 630 is near the MCP joint 337–340, the A3 pulley 634 is near the PIP joint 347–350 and the A5 pulley 638 is near the DIP joint 356–359.

The flexor tendons 602–608 are shown as one unit for each finger 365–368, but actually there are two flexor tendons to each unit. They are the flexor digitorum superficialis and the flexor digitorum profundus (shown as one, 602–608). These tendons 602–608 travel underneath the pulleys 630–638 and the flexor digitorum profundus attaches to the distal phalanx 360–363 of each finger 365–368. The tendons 602–608 move back and forth below the pulleys 630–638, via muscles (not shown) attached to the proximal end of the tendons. This movement of the tendon 602–608 produces finger 365–368 flexion. Protective padding, as discussed hereinafter, is placed in an anatomically designed fashion over the A2 and A4 pulley regions.

When the A2 and A4 pulleys 632 and 636 are preserved, adequate finger motion and grip strength is maintained.

Figure 6:
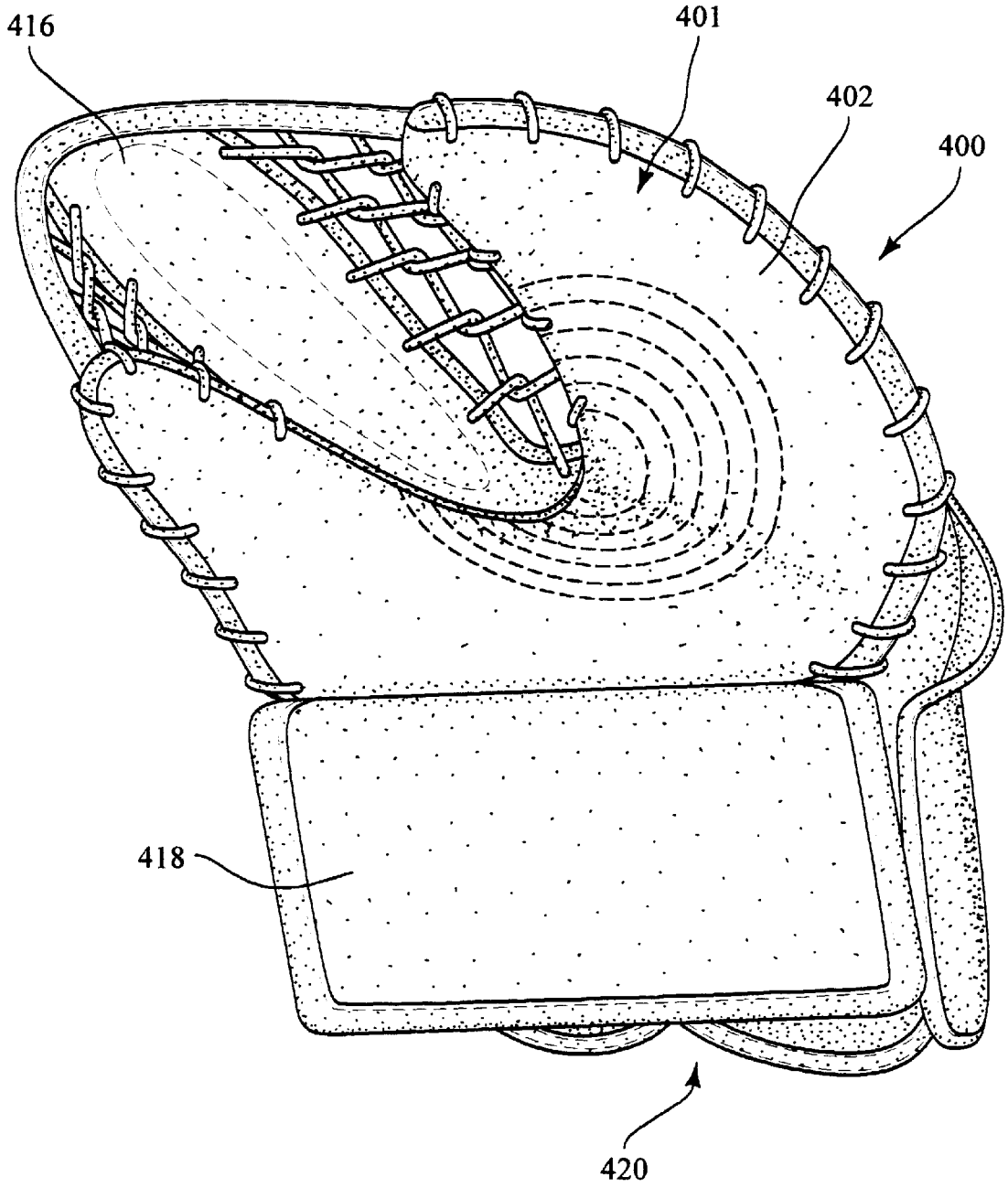
FIG. 6 is a perspective view of a hockey catch glove of the present invention.

In FIGS. 6, 8–11 a preferred goal tender's catch glove 400 is provided for the left human hand. The catch glove 400 includes a bottom glove panel 402 which covers the palmar side of the hand and a top glove panel 404 which covers the dorsal or back side of the hand. The bottom and top glove panels 402 and 404, respectively, are of a suitable material, usually leather, and are secured along their outer periphery, usually by lacing, as identified by the numeral 444 in FIG. 11, to form a generally oblong-shaped glove body 401. The oblong configured glove body includes a thumb section 406, a finger section 407, and a pocket 416, usually including webbing material therein, disposed between the thumb section 406 and the finger section 407. As best shown in FIG. 6, the catch glove is also provided with a cuff 418 with an opening 420 therein to receive a human hand. The cuff 418 generally extends along the wrist and lower forearm (not shown) of a wearer for additional protection of the wrist and lower forearm. The glove body 401, including the finger section 407, may be segregated into individual finger stalls or in some instances a plurality of finger stalls or the finger section may be a single stall to receive a plurality of fingers therein, as shown.

Figure 8:
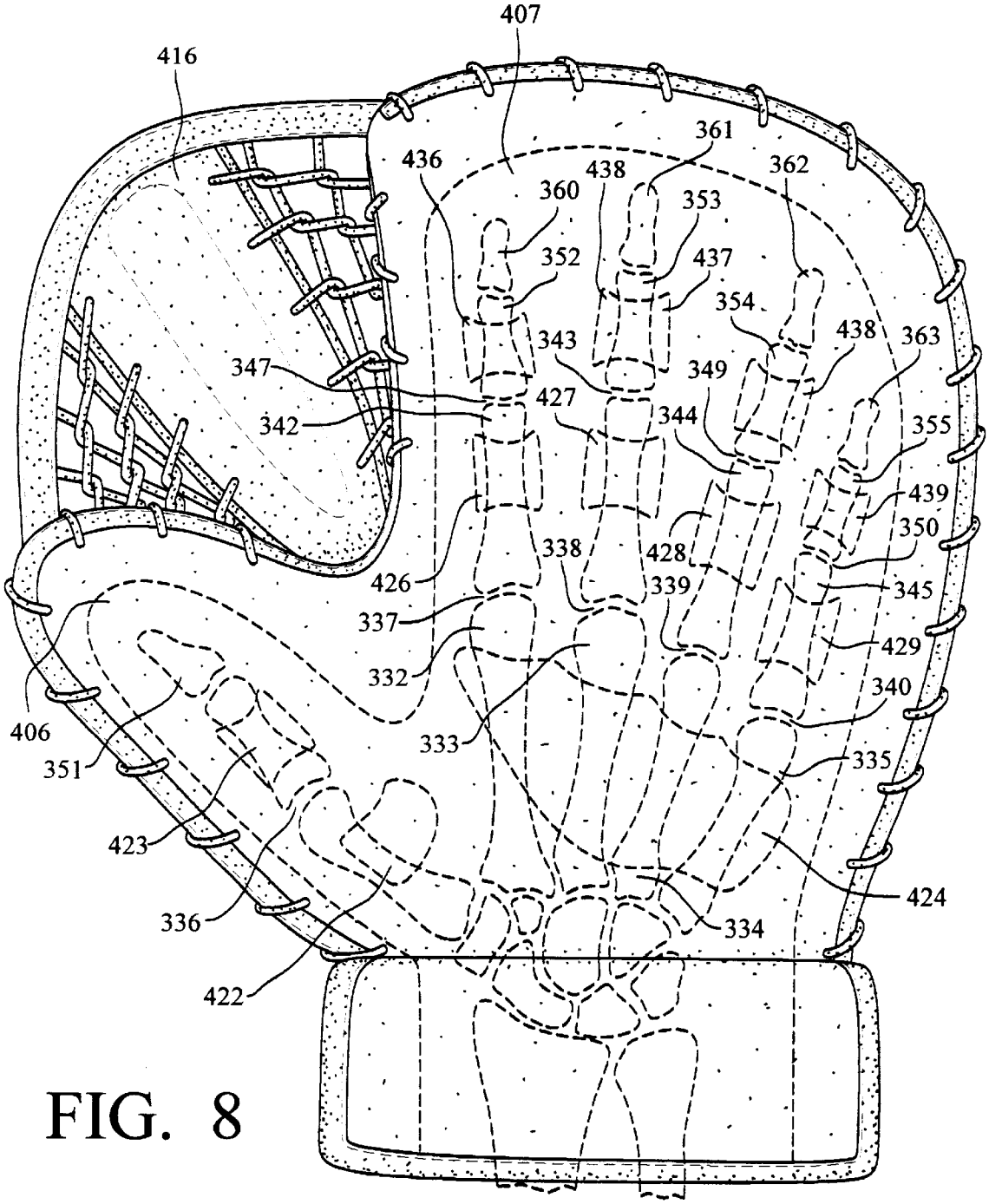
FIG. 8 is a bottom view of a preferred embodiment of a hockey goaltender's catch glove showing the palmar-side details and seen overlaying the skeletal structure of a left-palmar-side human hand inserted into the catch glove showing the locations for shock absorbing pads.
Figure 9:
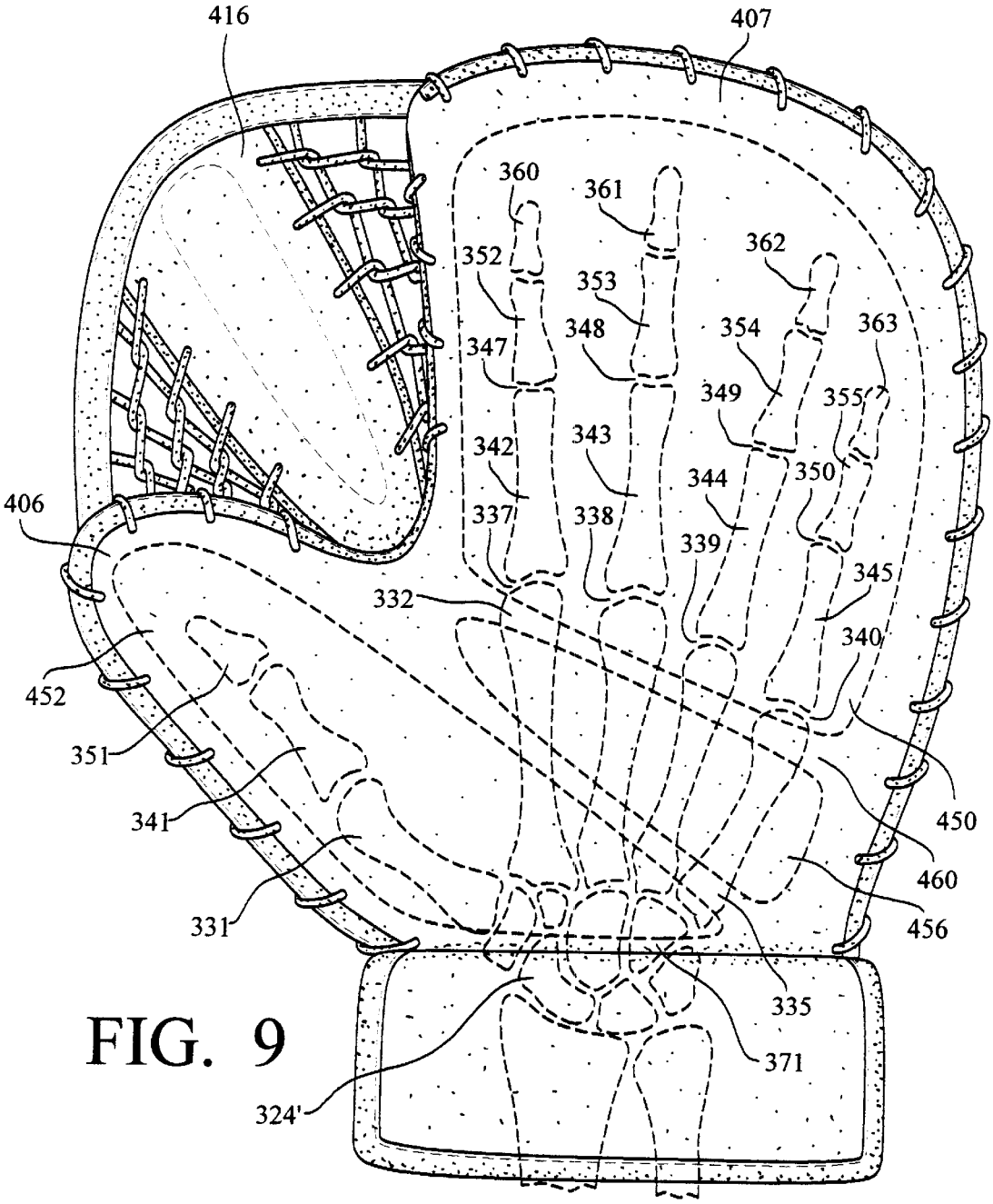
FIG. 9 is a bottom view of the preferred embodiment of FIG. 8 showing the palmar-side details and seen overlaying the skeletal structure of a left-palmar-side human hand and showing the stiffners in the catch glove.
Figure 10:
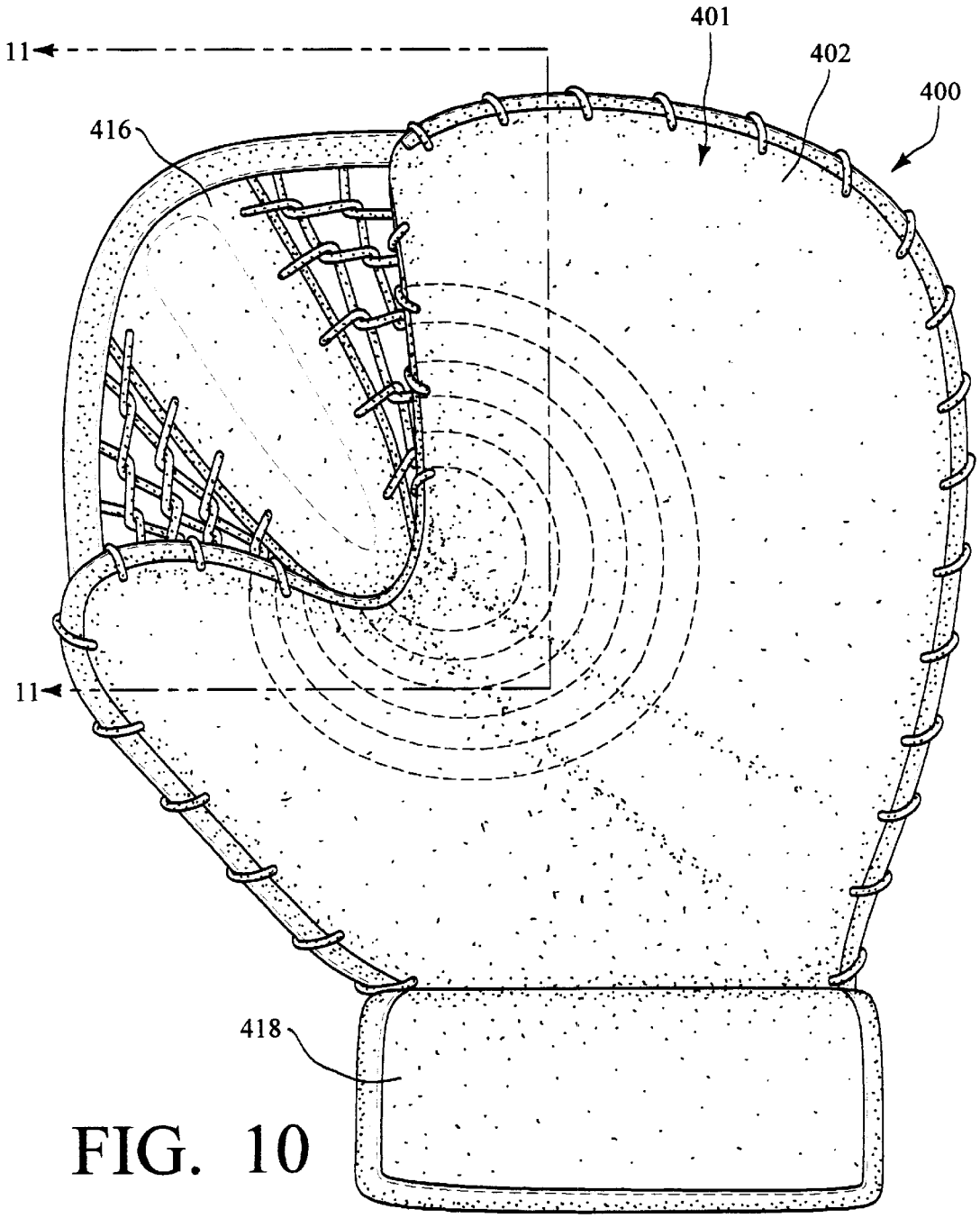
FIG. 10 is a bottom view of the hockey goalie catch glove of FIG. 6; and, FIG. 11 is sectional view taken along line 11—11 of FIG. 10.
Figure 11:
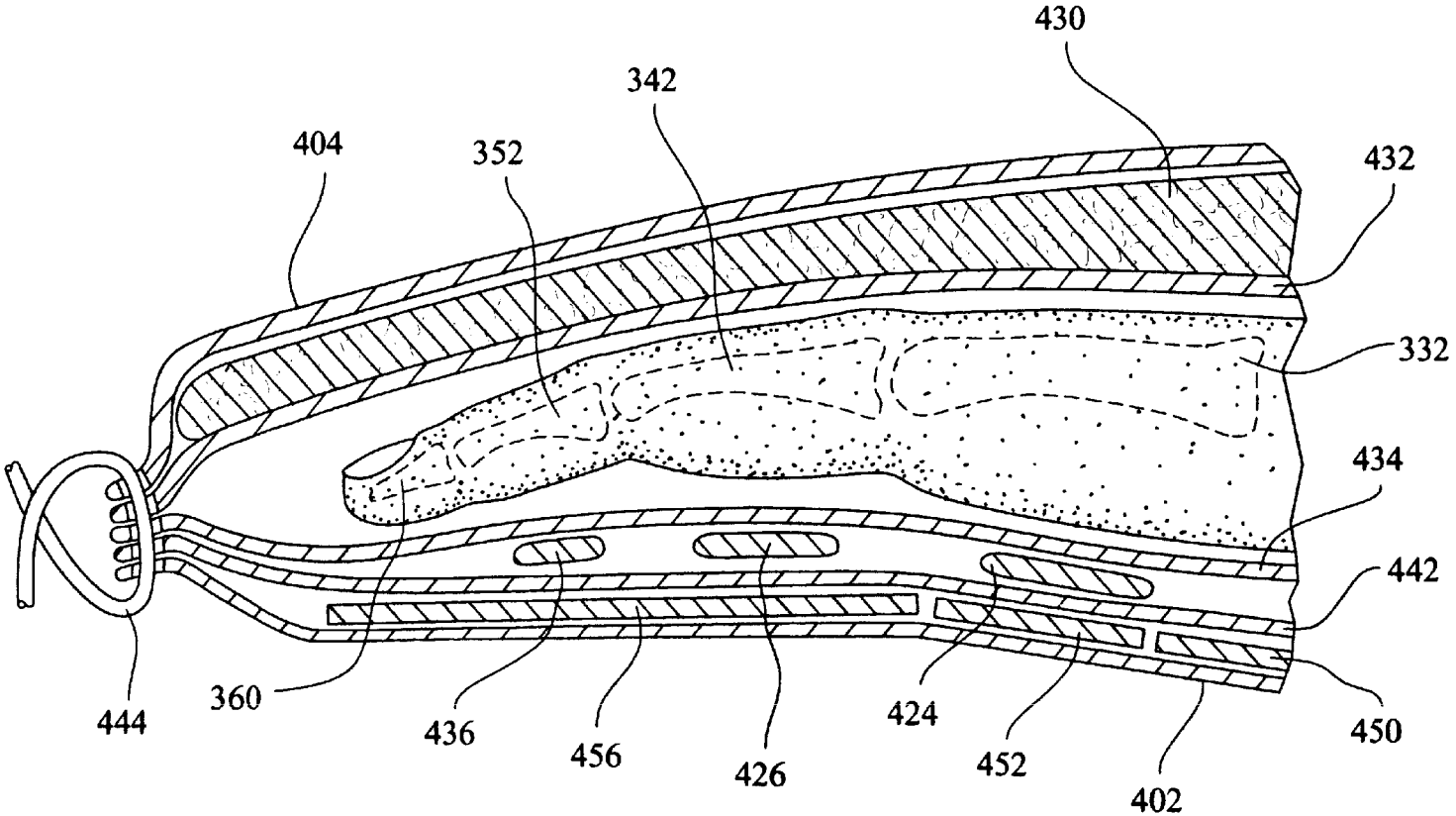

As best shown in FIG. 8, a plurality of shock absorbing pads, which is generally a foam rubber or other foam elastomeric material, is positioned to overlie selected areas above and below the center axis of rotation of at least the metacarpalphalangeal joint 337 of the index finger 365 and in a preferred embodiment overlies the areas above and below the center axis of rotation of it the metacarpalphalangeal joints 337–340 of all of the fingers 365–368 and above and below the center axis of rotation of the proximal interphalangeal joints 347–350 of all of the fingers 365–368. As shown in FIG. 8, the plurality of shock absorbing pads are positioned above and below the center axis of rotation of the metacarpalphalangeal joints 337–340 and the proximal interphalangeal joints 347–350. Shock absorbing pads 436, 437, 438, and 439 overlie the middle phalanxes 352, 353, 354 and 355 of the fingers and are positioned above the proximal interphalangeal joints 347, 348, 349 and 350, respectively. Shock absorbing pads 426, 427, 428 and 429 overlie the proximal phalanxes 342, 343, 344, and 345, respectively. The shock absorbing pads 436–439 and 426–429 are spaced to exclude the proximal interphalangeal joints 347, 348, 349 and 350. Also, as shown in FIG. 8, the shock absorbing pad identified as 424 overlies the distal half of the metacarpals 332, 333, 334 and 335, excluding the metacarpalphalangeal joints 337, 338, 339 and 340. The shock absorbing pad 424 is spaced from the shock absorbing pads 426–429 so that the distal ends of the metacarpals 332–336 which are adjacent the metacarpalphalangeal joints 337–340 define a primary motion zone identified by the numeral 460, as best shown in FIG. 9. Another shock absorbing pad 423 overlies the A2 pulley 622 which is attached to the proximal phalanx 341 of the thumb 364 and a shock absorbing pad 422 is positioned below the metacarpalphalangeal joint 336. Padding for the shock absorbing pad is usually a foam rubber or a foam plastic is generally about ¼" thick and is attached to an intermediate wall 434 which, as best shown in FIG. 11, is attached to either the top or bottom glove panel 404, 402 and is generally of the same shape and configuration as the glove body 401.

As shown in FIG. 9, stiffeners may also be employed in the instant invention to add further protection to the hand of the goalie. The stiffeners are preferably made of relatively hard plastic, or the like, such as a polyethylene or a polycarbonate or even a fiberglass. Generally, the stiffeners are no more than about ⅛" in thickness. As shown in FIG. 11, the stiffeners 450, 452 and 456 are attached to an inner facing 442 which is generally a cloth or felt-type material, cut generally to the shape of the glove body 401. The stiffeners 450, 452 and 456 are generally secured by any means to the inner facing 442 including lacing, gluing, sewing or any combinations thereof or any other well known methods for attaching the stiffeners to the facing.

As shown in FIG. 9, a first stiffener 450 is positioned above the center axis of rotation of the metacarpalphalangeal joints 337–340 and overlies the fingers 365–368 extending outwardly beyond the finger tips of the fingers. A second stiffener 452 is positioned to overlie a thumb and bony prominences above the distal radio ulnar joint 322 and the radio carpal joint 323. A third stiffener 456 is disposed to overlie the area below the center axis of rotation of the metacarpalphalangeals joints 337–340 of the fingers 365–368 covering the A1 pulleys and the distal ends of the metacarpals 332–335. Thus, the stiffeners cover the palmar side of the axis of rotation except for the center of the metacarpalphalangeal joints 337–340.

Referring back to FIG. 11, the fingers of the goalie, as illustrated by the metacarpal 332, the proximal phalanx 342, the middle phalanx 352 and the distal phalanx 360 are protected from a hockey puck by shock absorbing pads 424, 426, and 436 and the stiffeners 450, 452, and 456 wherein the stiffeners 450, 452, 456 are sandwiched between the shock absorbing pads 424, 426 and 436 and the bottom or palmar side glove panel 402 which receives the fast moving hockey puck or the like. Also, the back or dorsal side of the glove body 405 is also provided with padding material 430 which is disposed between intermediate lacing material 432 and the top or back side glove panel 404.

In the preferred embodiment, the shock absorbing pads are shown as protecting individual pulleys with individual pads and a single pad covering a plurality of pulleys. The number of pads used in a glove is not germane to the invention in that the invention lies in protecting specific areas of the hand while leaving other areas free for rotation or movement. For example, one pad may be used with sections cut-out around the center axis of rotation of the joints to be protected or a plurality of pads may be provided on opposite sides of the center axis of rotation of the joints to be protected. Thus, the detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A hockey catch glove comprising:

a bottom panel sized to cover a palm, thumb and fingers of a human hand and a top glove panel sized to cover a back, thumb and fingers of a human hand, said panels secured along each panel's periphery to define a glove body with an opening therein to receive a human hand, said panels having a thumb and a fingers section, said thumb and fingers section of said bottom panel in conjunction with said top panel providing a thumb stall and at least one finger stall for receiving a thumb and fingers of said human hand;

a pocket disposed between said thumb section and said fingers section;

a first shock absorbing pad positioned for location above and a second shock absorbing pad positioned for location below the center axis of rotation of a metacarpalphalangeal joint of an index finger, said metacarpal-phalangeal joint of said index finger being absent of said first and said second shock absorbing pad.

2. The hockey catch glove of claim 1 including a first stiffener disposed above the center axis of rotation of said metacarpalphalangeal joint of said index finger and the metacarpalphalangeal joints of a long finger, a ring finger and a small finger and for extending outwardly beyond finger tips of said fingers.

3. The hockey catch glove of claim 1 including a second stiffener for covering a thumb and bony prominences above the distal radio ulnar joint and radiocarpal joint.

4. The hockey catch glove of claim 1 including a third stiffener disposed for location below the center axis of rotation of said metacarpalphalangeal joint of said index finger, a long finger, a ring finger, and a small finger.

5. The hockey catch glove of claim 1 including a third shock absorbing pad for location above and a fourth shock absorbing pad for location below the center axis of rotation of an interphalangeal joint of an index finger.

6. The hockey catch glove of claim 1 including a third shock absorbing pad for overlying the bony prominences of the thumb proximal phalanx between the proximal and distal ends of the thumb proximal phalanx.

7. The glove of claim 1, said first and second shock absorbing pads being approximately ¼" thick.

8. The glove of claim 7, said first and second shock absorbing pads being a foam rubber or a foam plastic.

9. The glove of claim 1 including a third shock absorbing pad for location above and a fourth shock absorbing pad for location below the center axis of rotation of a metacarpal-phalangeal joint of a ring finger.

10. A hockey catch glove comprising:

a bottom glove panel sized to cover a palm, thumb and fingers of a human hand and a top glove panel sized to cover a back, thumb and fingers of a human hand, said panels secured along each panel's periphery to define a glove body with an opening therein to receive a human hand, said panels having a thumb and a finger section, said thumb and finger sections of said bottom panels in conjunction with said top panel providing a thumb stall and at least one finger stall for receiving a thumb and fingers of said human hand;

a pocket disposed between said thumb section and said finger section;

a first shock absorbing pad for location above and a second shock absorbing pad for location below the center axis of rotation of metacarpalphalangeal joints of an index finger, a ring finger, a long finger and a small finger, a third shock absorbing pad for location above the center axis of rotation of metacarpalphalangeal joints of said index finger, said long finger, said ring finger and said small finger, and a fourth shock absorbing pad for overlying the bony prominences of a proximal phalanx between the proximal and distal ends of a thumb proximal phalanx; and, a first stiffener disposed for location above the center axis of rotation of said metacarpalphalangeal joints of said fingers and for extending outwardly beyond the finger tips of said fingers, a second stiffener for covering a thumb and bony prominences above the distal radio ulnar joint and radio carpal joint, a third stiffener disposed for location below the center axis of rotation of said metacarpal joints of said fingers and for covering the A1 pulleys of said fingers, said stiffeners being sandwiched between said shock absorbing pads and said bottom panel.

11. The glove of claim 10, said shock absorbing pads being approximately ¼" in thickness.

12. The glove of claim 10, said shock absorbing pads being of foam rubber or a foam plastic.

13. The glove of claim 10, said stiffeners being approximately ⅛" in thickness.

14. The glove of claim 10, said stiffeners being a polyethylene, a fiberglass, or a polycarbonate.

* * * * *

UNITED STATES PATENT AND TRADEMARK OFFICE

CERTIFICATE OF CORRECTION

PATENT NO. : 6,453,474 B2
DATED : September 24, 2002
INVENTOR(S) : James M. Kleinert It is certified that error appears in the above-identified patent and that said Letters Patent is hereby corrected as shown below:

Title page,
Item [75], Inventor, change “Glenview, KY” to -- Louisville, KY --;

Column 2,
Line 58, change “other” to -- Other --;

Column 3,
Line 6, change “hands” to -- hand, --;
Line 42, after “inside the” delete “it”;

Column 4,
Line 4, after “bones” delete “.”;

Column 7,
Line 10, after “index” delete “25”;
Line 54, create hanging indent paragraph beginning with “Protection padding” indent lines 55, 56, 57, 58 and 59.

Signed and Sealed this

Twentieth Day of May, 2003

JAMES E. ROGAN
*Director of the United States Patent and Trademark Office*